US009021733B1

(12) United States Patent
DiChario

(10) Patent No.: US 9,021,733 B1
(45) Date of Patent: May 5, 2015

(54) ANTI-WALK PIN ASSEMBLY FOR A LOWER RECEIVER

(71) Applicant: American Tactical Imports, Inc., Rochester, NY (US)

(72) Inventor: Anthony DiChario, Pittsford, NY (US)

(73) Assignee: American Tactical Imports, Inc., Rochester, NY (US)

( * ) Notice: Subject to any disclaimer, the term of this patent is extended or adjusted under 35 U.S.C. 154(b) by 0 days.

(21) Appl. No.: 14/152,434

(22) Filed: Jan. 10, 2014

Related U.S. Application Data

(60) Provisional application No. 61/900,219, filed on Nov. 5, 2013.

(51) Int. Cl.
*F41A 19/10* (2006.01)
*F41A 19/14* (2006.01)
*F41A 3/66* (2006.01)

(52) U.S. Cl.
CPC ..... *F41A 3/66* (2013.01)

(58) Field of Classification Search
CPC ..... F41A 19/10; F41A 19/14
USPC ..... 42/31, 41, 42.01, 42.03, 43, 45, 48, 42/69.02, 69.03, 106, 69.01
See application file for complete search history.

(56) References Cited

U.S. PATENT DOCUMENTS 7,150,121 B1 * 12/2006 Clay ..... 42/69.01
2008/0060245 A1 * 3/2008 McCormick ..... 42/69.01

* cited by examiner

*Primary Examiner* — Samir Abdosh
*Assistant Examiner* — John D Cooper
(74) *Attorney, Agent, or Firm* — Woods Oviatt Gilman LLP; Katherine H. McGuire, Esq.

(57) ABSTRACT

An anti-walk pin assembly for securing a fire control group having a trigger, disconnector and hammer within a firearm. A lower receiver defines a fire control group receptacle for housing fire control group components. The lower receiver has trigger pin receiving openings each defining a trigger pin support surface. A trigger pin is received in the trigger pin receiving openings. The trigger and disconnector are pivotally mounted on the trigger pin. A threaded fastener engages with a threaded portion of the trigger pin support surface to restrict lateral movement of the trigger pin within the trigger pin receiving openings. Further optionally included are hammer pin receiving openings each defining a hammer pin support surface. A hammer pin is received in the hammer pin receiving openings. A threaded hammer fastener engages with a threaded portion of the hammer pin support surface to restrict lateral movement of the hammer pin.

7 Claims, 8 Drawing Sheets

ANTI-WALK PIN ASSEMBLY FOR A LOWER RECEIVER

This claims priority to U.S. Provisional Application Ser. No. 61/900,219 filed on Nov. 5, 2013 and is incorporated herein by reference.

FIELD OF THE INVENTION

The present invention relates to a rifle, and more particularly, to a modular automatic or semi-automatic assault-type rifle. Specifically, the present invention relates to a lower receiver configured for use within a modular assault-type rifle and an anti-walk pin assembly for use with such lower receiver.

BACKGROUND OF THE INVENTION

There are a number of automatic and semi-automatic rifles used by military personnel as well as law enforcement and civilians. While fully automatic rifles are generally illegal for use by the civilian population, many of the components which constitute an automatic rifle are the same as those found within semi-automatic models legalized for civilian use. Arguably the most popular semi-automatic assault-type rifle used by civilians, particularly within the United States, is the AR-15 and its clones. AR-15 is a registered trademark of Colt Industries. A number of additional companies manufacture clones of the AR-15 and market these clones under separate trademarks. While used throughout the specification, it is to be understood that the term AR-15 is meant to include not only those rifles manufactured by Colt Industries, but also those additional clones and any variants thereof. The AR-15 is the semi-automatic variant of the fully automatic M16 rifle used by United States military personnel.

The AR-15 and M16 are designed as modular rifles generally comprising a buttstock, lower receiver, upper receiver and barrel assembly. Each component is separable from one another and affords rifle owners the opportunity to customize the rifle with after-market components such as barrels of differing lengths, upper receivers designed to handle different calibers of ammunition, flashlights, hand guards, grenade or flare launchers, flash or sound suppressors, grips, and front or rear sights. To operate, the lower receiver is configured to include a fire control group ("FOG") (generally a trigger, hammer, disconnector, and associated hardware including pins and springs) and a magazine box wherein activation of the FCG (by manipulation of the trigger) causes a round (bullet) housed within the chamber of the upper receiver to be fired out the barrel of the rifle by action of a reciprocating bolt carrier group housed within the upper receiver. Internal mechanisms of the upper receiver expel the shell casing of the fired round from the chamber while components engaged with the magazine box housed within the lower receiver feed a new round into the now-empty chamber. The buttstock mounts to the lower receiver and includes a buffer assembly and action (or recoil) spring in communication with the bolt carrier group. After a spent shell has been discharged, the spring urges the bolt carrier group back toward the chamber in preparation for firing another round.

The modular construction of these rifles enables generally quick and easy field-stripping (disassembly of the rifle for cleaning of the rifle to ensure proper firing of the weapon). In field-stripping the rifle, the lower receiver is separated from the upper receiver to gain access to the internal components (bolt, bolt carrier group, FCG and respective associated hardware) for cleaning and re-lubrication. When assembled, the upper and lower receivers are secured to one another through rear and forward extensions on the upper receiver fitting between corresponding sidewalls forming notches or grooves on the lower receiver. The forward sidewalls and extension are fitted with a pivot pin to prevent the forward halves of the receivers from separating. Similarly, the rear sidewalls and extension employ a takedown pin to secure the two receivers together. To field-strip the rifle, the takedown pin is sufficiently pushed out of the extension so as to enable the rear extension to lift out of the rear sidewalls thereby pivoting the lower and upper receivers about the pivot pin. The pivot pin can then be pushed out a sufficient distance so as to enable removal of the front extension from the front sidewalls and thereby completing separation of the lower receiver from the upper receiver.

After a rifle has been field-stripped, the FCG can be removed from the lower receiver for cleaning or to swap in a different/customized FCG. Swapping FCGs permits owners to modify the trigger "feel" of the rifle by modifying the smoothness of the trigger pull or the trigger pull weight. Removal of the FCG first requires the removal of the hammer pin which holds the hammer in place within the lower receiver. With the hammer and hammer spring removed, the trigger pin is removed from the lower receiver thereby freeing the trigger and disconnector for removal. Each of the removed parts may be cleaned or a new FCG may be selected for insertion into the lower receiver.

Replacing the FCG reverses the above steps such that the trigger and disconnector (with appropriate springs in proper position and orientation) is dropped into the lower receiver. The through-bores machined within the trigger and disconnector are aligned with one another and with the associated receiving openings fabricated within the lower receiver. The trigger pin is then slid through the one of receiver openings, the trigger/disconnector through-bores and finally the second receiver opening thereby capturing the trigger/disconnector within the lower receiver. The hammer (with properly mounted hammer spring) is then engaged with the trigger and disconnector with the hammer retained in place on the lower receiver by passing the hammer pin through the proper opening on the receiver and passing the hammer pin through the through-bore of the hammer. The length of the trigger pin and hammer pin are each selected so that each end of the pins will sit flush with the outer surface of the lower receiver when assembled.

In general, one leg of the hammer spring engages and rests within a groove formed within the trigger pin. The groove generally circumnavigates the pin so that if the trigger pin should rotate the hammer spring will remain within the groove. The leg of the hammer spring resting within the trigger in groove prevents walking (lateral displacement) of the trigger pin out the side of the lower receiver. However, if the groove becomes worn or should the hammer spring leg otherwise disengage from the trigger pin groove, the trigger pin may walk laterally (particularly when subjected to the oscillatory impacts associated with firing a semi-automatic rifle) leading to a non-functional weapon and a dangerous and potentially fatal situation. It is also possible for the trigger pin to fail and fracture, particularly at the groove where the pin has a smaller diameter.

A number of solutions have been proposed to alleviate the possibility of trigger pin walking and/or fracturing. For instance, one proposed solution has been to extend the length of the trigger pin and/or hammer pin so that one or both ends of the pin protrude from the outer surface of the lower receiver. The protruding ends are then secured with a clip, such as a c-clip, such that the c-clips prevent the pin from traveling laterally. While this solution may arguably prevent pin walking, the extended pin length and clips present alternative problems. Primarily, the extended pin and clips may interfere with the rifle operator, particularly if wearing gloves which may snap the end of the pin or the clip. An operator may also be cut by the sharp edge of the pin or on a point of the clip. This cut may hinder firing of the rifle if that cut happens to be on the operator's trigger finger where the cut can cause discomfort as the injured finger applies the necessary trigger weight to fire the rifle.

A further, similar approach does not extend the pin or add a clip, but rather employs a headed fastener passing though the lower receiver to engage the pin while the head rests outside the outer surface of the lower receiver. This approach has the trigger pin and/or hammer pin of the same nominal width of the originally supplied pins. However, this solution modifies those pins so that each end of the pin is adapted to carry a threaded bore. Once properly inserted into the lower receiver, each end of the pin is capped with a respective cap screw with the screw head resting outside of the lower receiver to prevent pin walking. Ideally, the cap screw seats against the pin and not against the lower receiver. In this manner, the pin is allowed to rotate thereby minimizing wear on the pin (and thus minimize the potential for pin fracture). However, as the heads of the cap screws extend outside the outer surface of the lower receiver, this solution presents the same drawbacks as those of the clip as discussed previously.

As such, there is a need for an anti-walk pin assembly for use with a lower receiver assembly which secures the trigger pin and/or hammer pin within the lower receiver without hindering operator use of the rifle. The present invention addresses these and other needs.

BRIEF SUMMARY OF THE INVENTION

In general, one embodiment the present invention is directed to an anti-walk pin assembly for securing a fire control group ("FCG")—having a trigger, disconnector and hammer—within a firearm. The anti-walk pin assembly comprises a lower receiver defining a FCG receptacle for housing at least one or more FCG components. The lower receiver has trigger pin receiving openings each defining a trigger pin support surface. A trigger pin is at least partially received in the trigger pin receiving openings wherein the trigger and disconnector are pivotally mounted on the trigger pin. A threaded fastener is adapted to engage with a threaded portion of a respective trigger pin support surface to restrict lateral movement of the trigger pin within the trigger pin receiving openings.

Preferably, the lower receiver further includes an opposing pair of buttons integrally formed thereon. Each button extends outwardly from a generally planar surface of the lower receiver with each button defining a respective trigger pin receiving opening.

In a further embodiment, an anti-walk pin assembly comprises a lower receiver defining a FCG receptacle for housing at least one or more FCG components. The lower receiver has trigger pin receiving openings each defining a trigger pin support surface and hammer pin receiving openings each defining a hammer pin support surface. A trigger pin is at least partially received in the trigger pin receiving openings with the trigger and disconnector pivotally mounted on the trigger pin. A hammer pin is at least partially received in the hammer pin receiving openings with the hammer pivotally mounted on the hammer pin and wherein the hammer is operably engaged with the trigger and disconnector. A threaded trigger fastener is adapted to engage with a threaded portion of a respective trigger pin support surface to restrict lateral movement of the trigger pin within the trigger pin receiving openings. A threaded hammer fastener adapted to engage with a threaded portion of a respective hammer pin support surface to restrict lateral movement of the hammer pin within the hammer pin receiving openings. The lower receiver may further include an opposing pair of trigger opening buttons and an opposing pair of hammer opening buttons integrally formed thereon. Each button extends outwardly from a generally planar surface of the lower receiver wherein respective buttons define a respective trigger pin receiving opening or hammer pin receiving opening.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
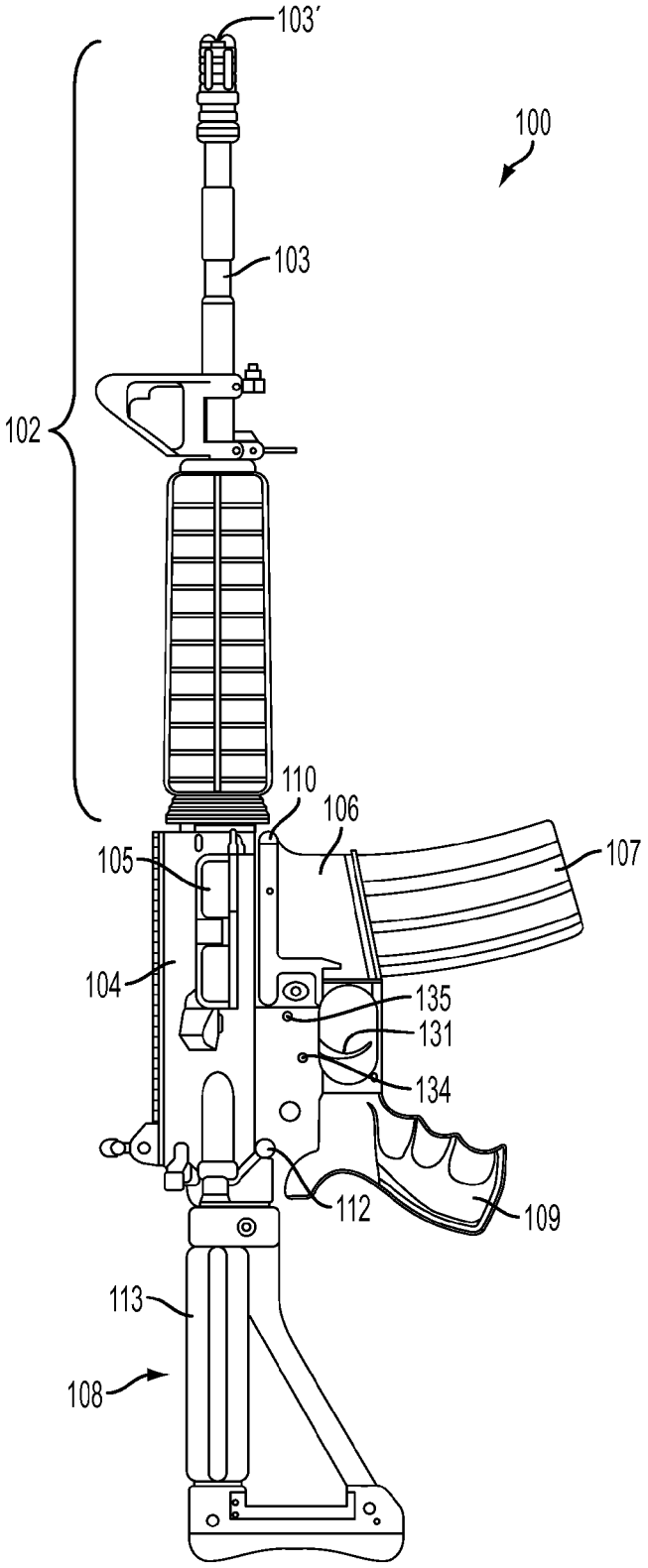
FIG. 1 is a side view of a representative modular rifle suitable for incorporating an embodiment of an anti-walk pin assembly in accordance with present invention.
Figure 2:
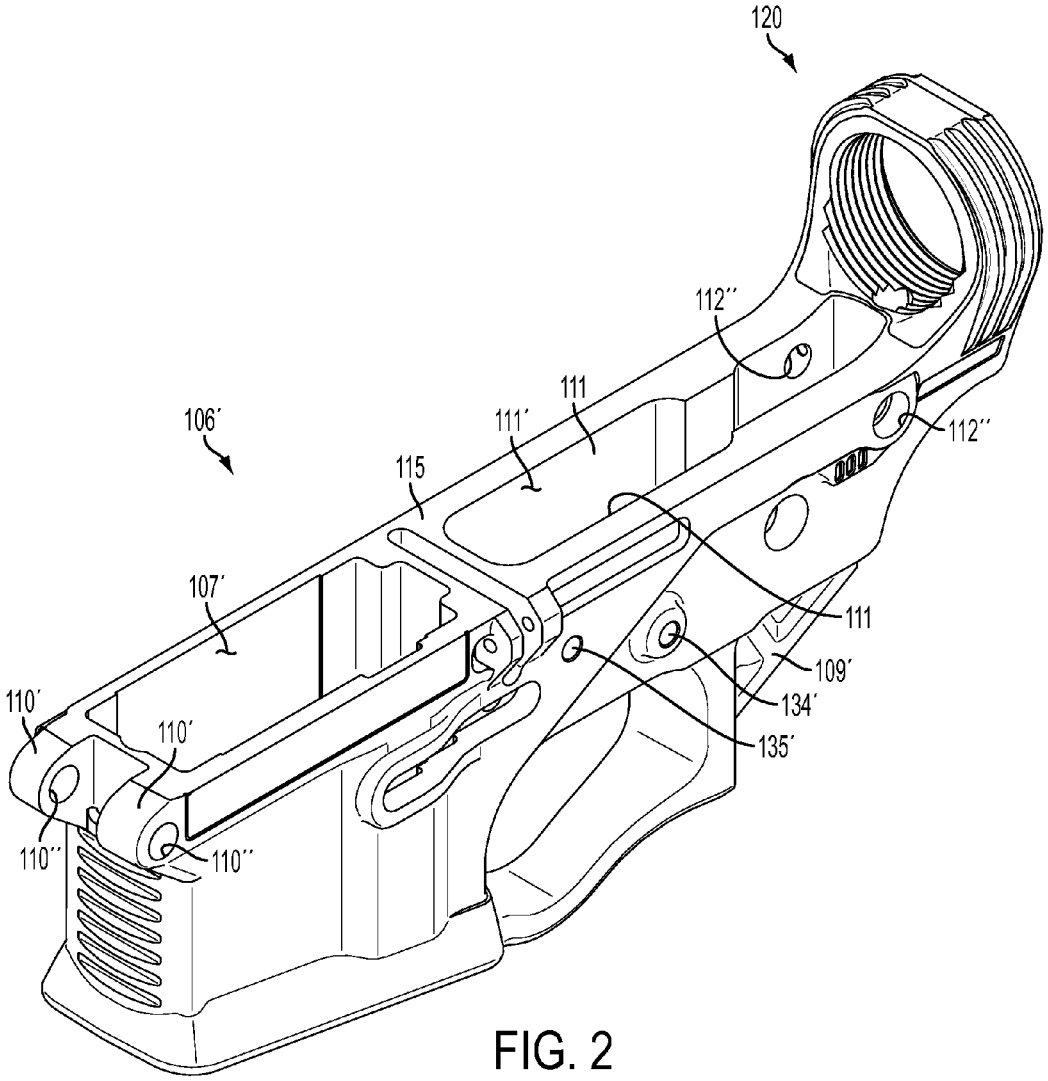
FIG. 2 is a perspective view of a lower receiver.

Referring to the drawings in detail, and specifically to FIGS. 1 and 2, a rifle, such as the AR-15, is generally indicated by reference numeral 100. Rifle 100 is a modular firearm consisting of a number of components and subcomponents. Major components of rifle 100 include barrel assembly 102, upper receiver 104, lower receiver 106 and buttstock 108. Lower receiver 106 is shown in greater detail in FIG. 2. To assemble a completed rifle, upper receiver 104 is positioned atop lower receiver 106 such that front and rear projections on the upper receiver (not shown) rest within a notch or groove formed within sidewalls 111 of the lower receiver. The upper portion of the forward end of sidewalls 111 terminate in lobes 110' while the rear portion of sidewalls 111 terminate at upwardly extending lobe 120. Each projection and respective sidewalls includes a corresponding through-hole. Sidewall through-holes 110" and 112" are configured to align with a respective through-hole of the upper receiver whereby a pin is inserted into and passes within each through-hole to secure the two receivers together. Pivot pin 110 detachably secures the front projection of the upper receiver within the lower receiver while takedown pin 112 secures the rear projection.

Upper receiver 104 houses the chamber 105 which holds a round (bullet) in position for firing, along with the bolt, bolt carrier, charging handle and related mechanisms used to initiate discharge of the round. Barrel assembly 102 is secured to upper receiver 104 generally through a threaded connection and includes a barrel 103 in operational communication with the chamber of the upper receiver such that a round fired from the chamber 105 passes down the length of the barrel and exits the firearm at barrel end 103'. Rounds are introduced into the chamber by way of magazine 107 fitted to the lower receiver. A grip 109 (such as a pistol grip, as shown) allows the user to aim and control the rifle while placing the user's trigger index finger in close proximity to the trigger. In this manner, the user can aim the rifle to the target and extend the trigger index finger to engage the trigger without losing control or accuracy of the rifle. The trigger 131 engages with the bolt carrier group in the upper receiver so that manipulation of the trigger results in firing of the rifle.

Lower receiver 106 includes an upwardly extending lobe 120 (see FIG. 2). Buttstock 108 is detachably mounted to upwardly extending lobe 120 so that a receiver extension 113 is in operational alignment with the bolt carrier housed within the upper receiver. Receiver extension 113 generally houses an action (or recoil) spring and buffer assembly (not shown). Upon discharge of a round, the bolt carrier within the upper housing is driven rearward by action of the gas discharged by the firing action. The buffer assembly and action spring dampen the kickback experienced by the user while also redirecting the firing mechanism back toward the chamber in preparation for firing another round.

As shown in FIG. 2, lower receiver 106 has a top surface 115 which is a generally flat surface configured with receptacles defined by sidewalls 111 for accepting the internal mechanisms required to operate the rifle. For instance, magazine receptacle 107' is configured to accept an ammunition magazine 107 and associated hardware to direct rounds loaded within the magazine into the chamber in the upper receiver. Receptacle 111' is adapted to house one or more mechanical components of a fire control group ("FCG") which generally includes a trigger, disconnector and hammer, which will be discussed in greater detail in the following paragraphs. Sidewalls 111 have receiving openings 134' and 135' defining support surfaces for accepting trigger pin 134 and hammer pin 135, respectively. (See FIG. 1). Lower receiver 106 is further adapted with a grip mounting interface 109' for securing, for example, a pistol grip 109.

Figure 3:
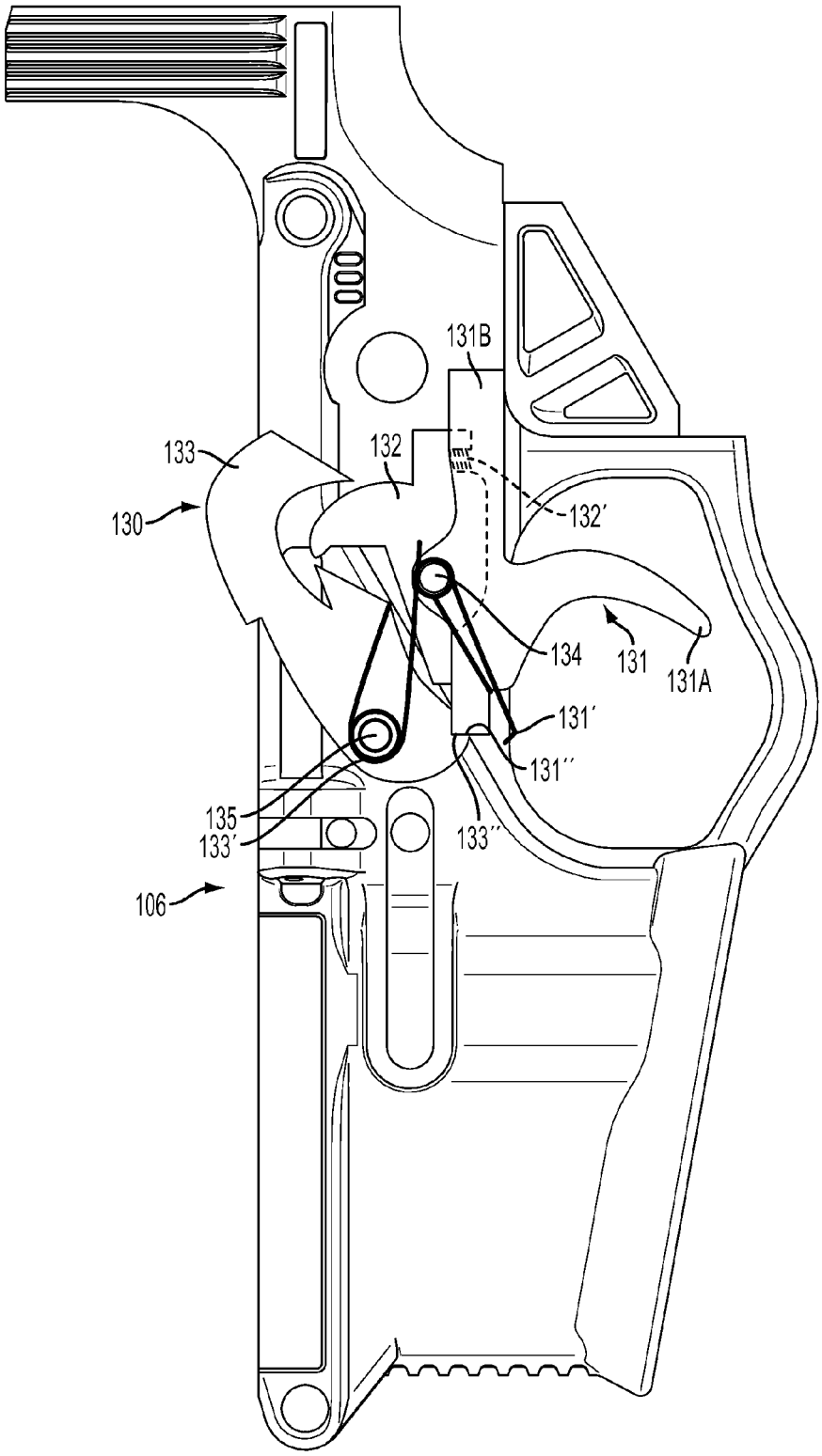
FIG. 3 is a side cross-sectional view of a lower receiver showing a fire control group and anti-walk pin assembly.
Figure 4:
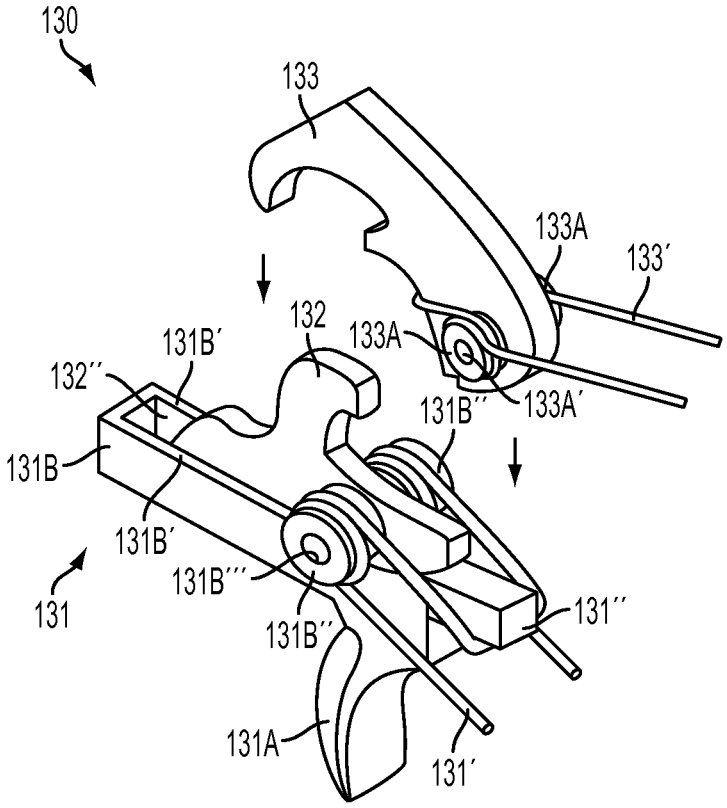
FIG. 4 is a perspective view of an isolated fire control group.

With reference to FIGS. 3 and 4, discharging of a round is controlled by user activation of a FCG 130 which generally comprises a trigger unit 131, disconnector 132 and hammer 133. To fire a round, the user applies (through a trigger finger) the requisite amount of trigger weight to trigger lever 131A to overcome the tension applied by the trigger spring 131'. Once the spring tension is overcome the trigger unit pivots about trigger pin 134. Pivoting of the trigger unit causes trigger sear surface 131" to disengage from hammer sear surface 133". Hammer 133 is under spring tension as applied by hammer spring 133' torsionally resting one leg of the hammer spring upon trigger pin 134 (as shown in FIG. 3). Once the sear surfaces have disengaged, the spring tension of the hammer spring is released causing the hammer 133 to pivot about hammer pin 135. The hammer 133 then impacts a firing pin within the bolt carrier in the upper housing discharging the round. Disconnector 132 functions to capture the rebounding hammer 133 to prevent the firing of more than one round with each pull of the trigger. Proper action of disconnector 132 is regulated by disconnector spring 132' housed within trigger body 131B.

To assemble the FCG, trigger spring 131' is mounted onto trigger lobes 131B" situated on trigger body sidewalls 131B' on trigger body 131B. Disconnector spring 132'" is then placed within trigger channel 132" of trigger body 131B followed by placement of disconnector 132 within the trigger channel. Each trigger lobe 131B" is configured to have trigger lobe through-bores 131B'" while disconnector 132 has a similar through-hole 132A (see FIG. 5) such that when mounted properly, trigger lobe through-bores 131B'" align with the disconnector through-hole. The preassembled trigger unit 131 and disconnector 132 (along with the trigger spring and disconnector spring) are then dropped into FCG receptacle 111' such that the aligned through-bore of the properly mounted trigger unit/disconnector correspond to the trigger pin receiving openings 134' found in the lower receiver. With all of the openings in alignment, trigger pin 134 is slid into place from one side of the lower receiver. As designed by most original equipment manufacturers, the trigger pin is inserted until each end of the pin generally sits flush with the external surface of the lower receiver. To finish assembling the FCG, the hammer spring 133' is mounted onto hammer lobes 133A of hammer 133, with the combined unit then placed within FCG receptacle 111' ensuring that through-bore 133A' aligns with hammer pin receiving opening 135' on the lower receiver and that the protruding legs of hammer spring 133' rest upon trigger pin 134 as shown in FIG. 3. Hammer pin 135 is then slid into place from one side of the lower receiver. Again, as most frequently designed, the ends of the hammer pin generally sit flush with the external surface of the lower receiver.

Figure 5:
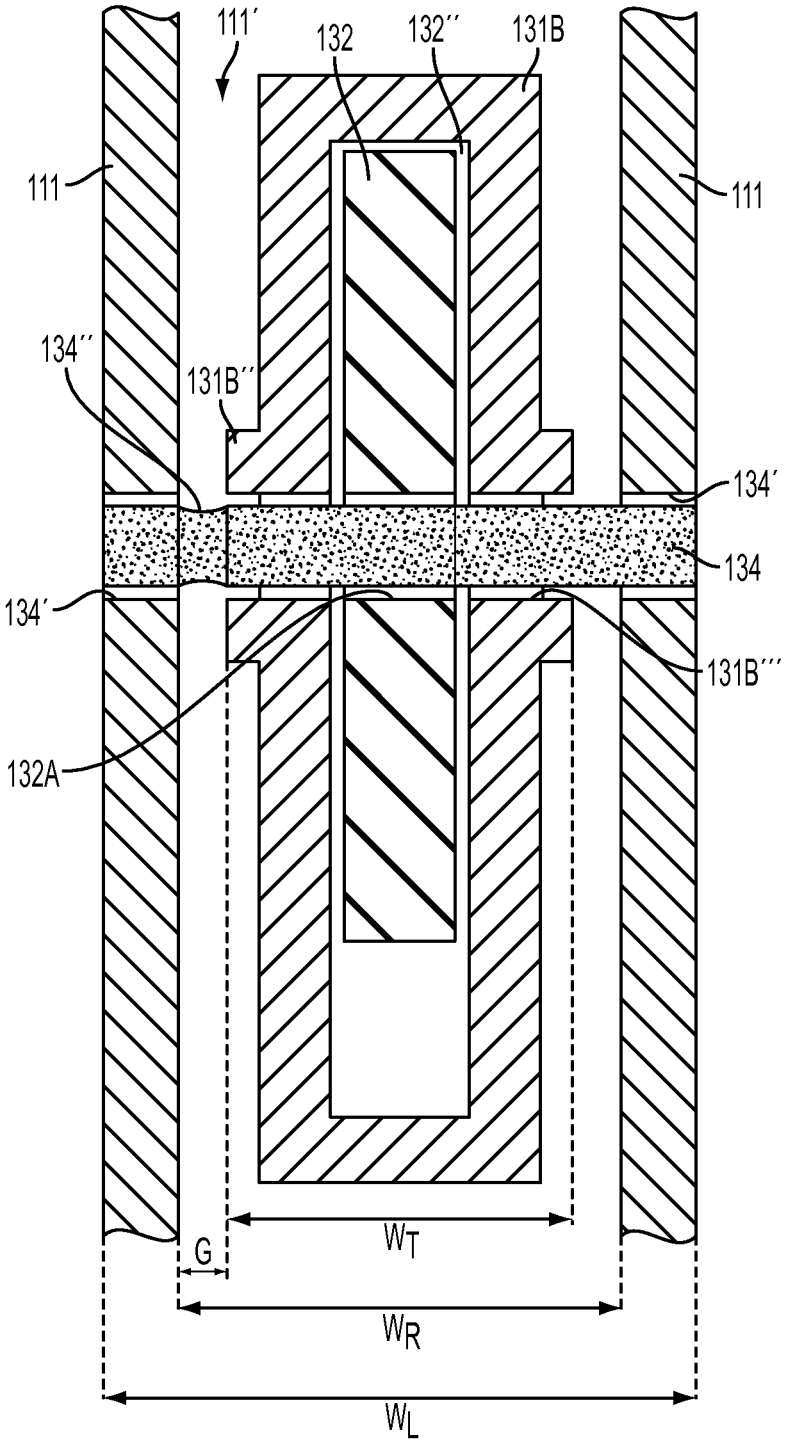
FIG. 5 is a top cross-sectional view of a prior art fire control group and trigger pin.

Shown in FIG. 5 is top cross-sectional view of an FCG (without a hammer, hammer spring or hammer pin) mounted within FCG receptacle 111' as generally known in the art. As discussed above, disconnector 132 is positioned within channel 132" of trigger body 131B such that the through-bores located therein align with one another. The unit is then placed within FCG receptacle and secured in place by sliding trigger pin 134 from one side of the lower receiver until each end of the trigger pin 134 sits flush with the external surface of lower receiver sidewalls 111. That is, the length of trigger pin 134 is substantially the same as the width $W_L$ of the lower receiver as measured from the external faces of opposing sidewalls 111. Trigger pin receiving openings 134', trigger lobe through-bores 131B'", and the disconnector through-hole 132A are each fabricated to have a bore diameter slightly larger than the diameter of trigger pin 134 such that trigger pin 134 fits snuggly within, and is supported by, the trigger pin receiving openings 134'. This snug fit, however, is insufficient to prevent lateral walking of the trigger pin when the rifle is being fired.

A prior art attempt to resolve the issue of trigger pin walking employs a circumferential groove 134" machined into trigger pin 134 proximate one end of the pin. The width, $W_T$, of the trigger body and trigger lobes 131B" is slightly smaller than the width, $W_R$, of the FCG receptacle 111' so as to define a gap G between the trigger lobes 131B" and the internal surface of lower receiver sidewalls 111. Circumferential groove 134" on trigger pin 134 is machined to coincide with gap G. As discussed above and as shown generally in FIG. 3, when properly assembled the legs of hammer spring 133' rest upon trigger pin 134. In the prior art FCG as shown in FIG. 5, one leg of hammer spring 133' rests within a portion of circumferential groove 134". This engagement of the leg of the hammer spring in the groove inhibits lateral movement of the trigger pin. Nevertheless, walking of the trigger pin may still occur should the groove become worn or should the leg of the hammer spring otherwise become disengaged from the groove.

Figure 6:
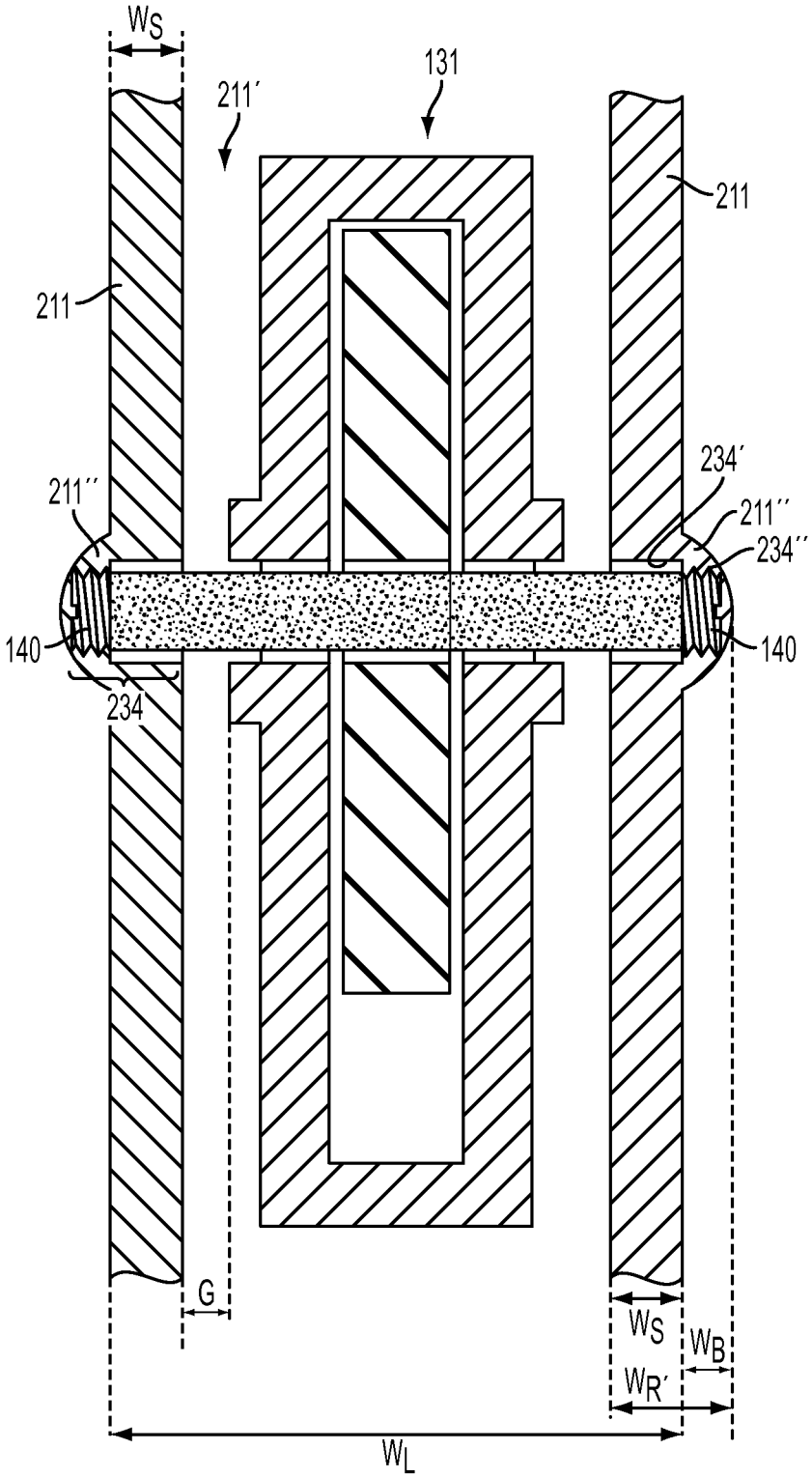
FIG. 6 is a top cross-sectional view of a fire control group and a first embodiment of an anti-walk pin assembly in accordance with the present invention.

A first embodiment of an anti-walk pin assembly in accordance with the present invention is shown in FIG. 6. In this embodiment the fire control group is constructed of the same materials as initially supplied by the original equipment manufacturer ("OEM"), and may in fact be a fire control group removed from a previously purchased complete rifle, such as FCG 131 described above. However, unlike the prior art, this FCG is mounted within a modified lower receiver. The modified lower receiver of the embodiment shown in FIG. 6 includes lower receiver sidewalls 211 having a sidewall width $W_S$ and a total lower receiver width $W_L$ nominally the same as those of an OEM lower receiver (such as that shown and described above with regard to FIG. 5). This in turns yields a nominally identical fire control group receptacle 211' when compared with the prior art receptacle 111', as well as a nominally identical gap G between the inner wall of the lower receiver and the trigger body lobe of the trigger unit.

The modified lower receiver, however, includes the further provision of a pair of buttons 211" integrally formed on the external generally planar surface of the lower receiver. The position of the buttons overlaps the portion of the lower receiver housing the trigger pin receiving openings to form a combined receiving opening 234. That is, buttons 211" serve to selectively build up the surface thickness of the lower receiver only in those areas immediately surrounding the trigger pin receiving opening. Thus, the lower receiver thickness at the buttons, $W_{R'}$, is equal to the width of the lower receiver sidewall, $W_S$, plus the width, $W_B$, of the button.

In a preferred embodiment, combined receiving opening 234 is generally segregated into a non-threaded portion 234' and a threaded portion 234". Preferably non-threaded portion 234' has a length substantially equal to the width of the sidewall, $W_S$ and is generally proportioned to support trigger pin 134. Threaded portion 234" is generally solely situated within the button and generally has a thread depth equal to, or slightly less than the button width, $W_B$. Coupled to each threaded portion is a threaded fastener, such as set screw 140. When set screw 140 is engaged with its respective threaded portion 234", trigger pin 134 is restricted from traveling laterally within receiving opening 234. Set screw 140 may be threaded within the receiving opening until butting against trigger pin 134, or may be threaded such that a minimal gap is formed between the leading end of the set screw and the trigger pin. It is further preferred that the external end of set screw 140 rests below the external surface of button 211" so as to form a generally seamless and smooth exterior surface of the lower receiver proximate the trigger pin receiving opening while preventing the possibility of trigger pin walking. This seamless construction eliminates the potential to snag a glove or finger as is possible in many prior art anti-walking pin assemblies.

Figure 7:
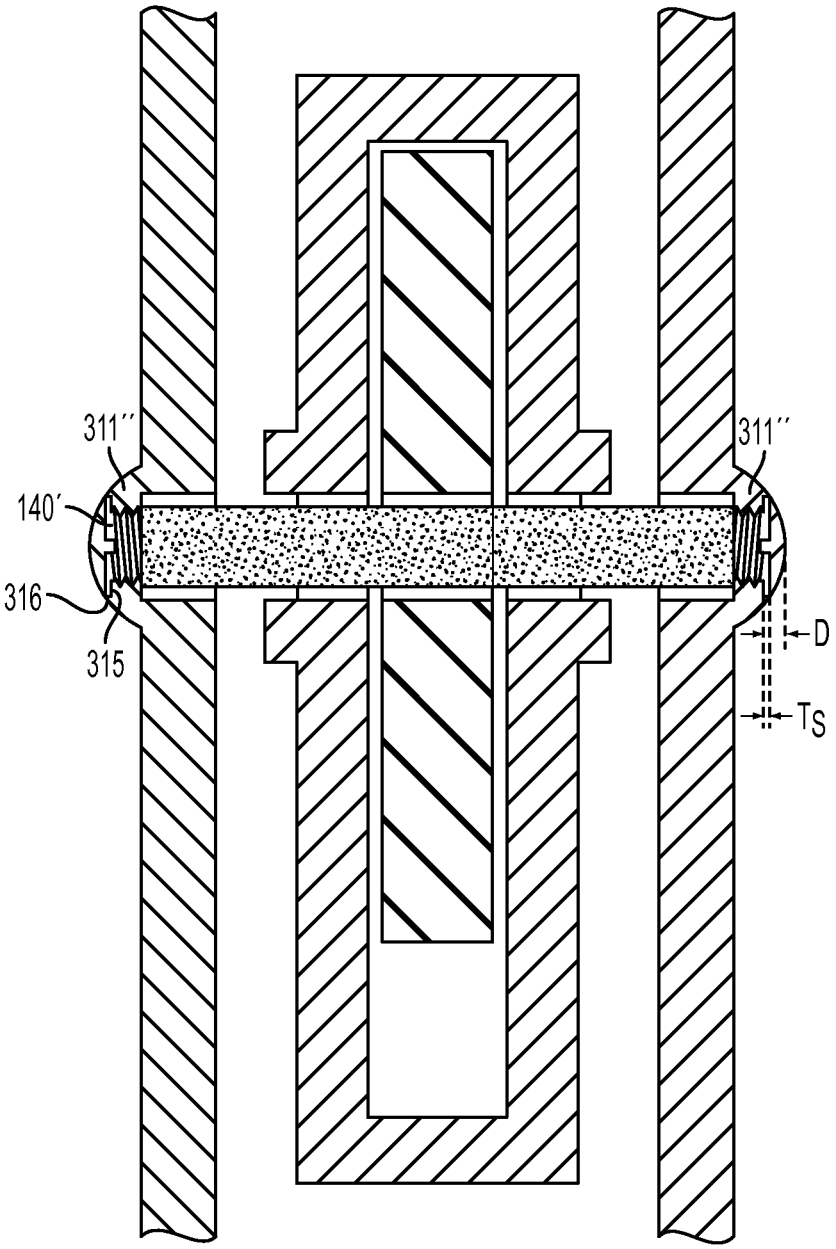
FIG. 7 is a top cross-sectional view of a fire control group and a second embodiment of an anti-walk pin assembly in accordance with the present invention.

An alternative embodiment of an anti-walk pin assembly in accordance with the present invention is shown in FIG. 7. This embodiment is identical to that shown and described above with regard to FIG. 6 but for the modification of the receiving opening situated within the portion of the button. As shown in FIG. 7, button 311" has been modified to include a recessed portion defined by recess base 315 and recess sidewall 316. The recess is adapted to house the head of threaded fastener 140'. Threaded fastener 140' can be any suitable fastener, such as a bolt, but is preferably a fillister head screw. The thickness, $T_S$, of the screw head is preferably less than the depth, D, of the sidewall 316 of the recess. Thus, when threaded fastener is engaged with the threaded button 311" the exterior of the head sits below the external surface of the button.

Figure 8:
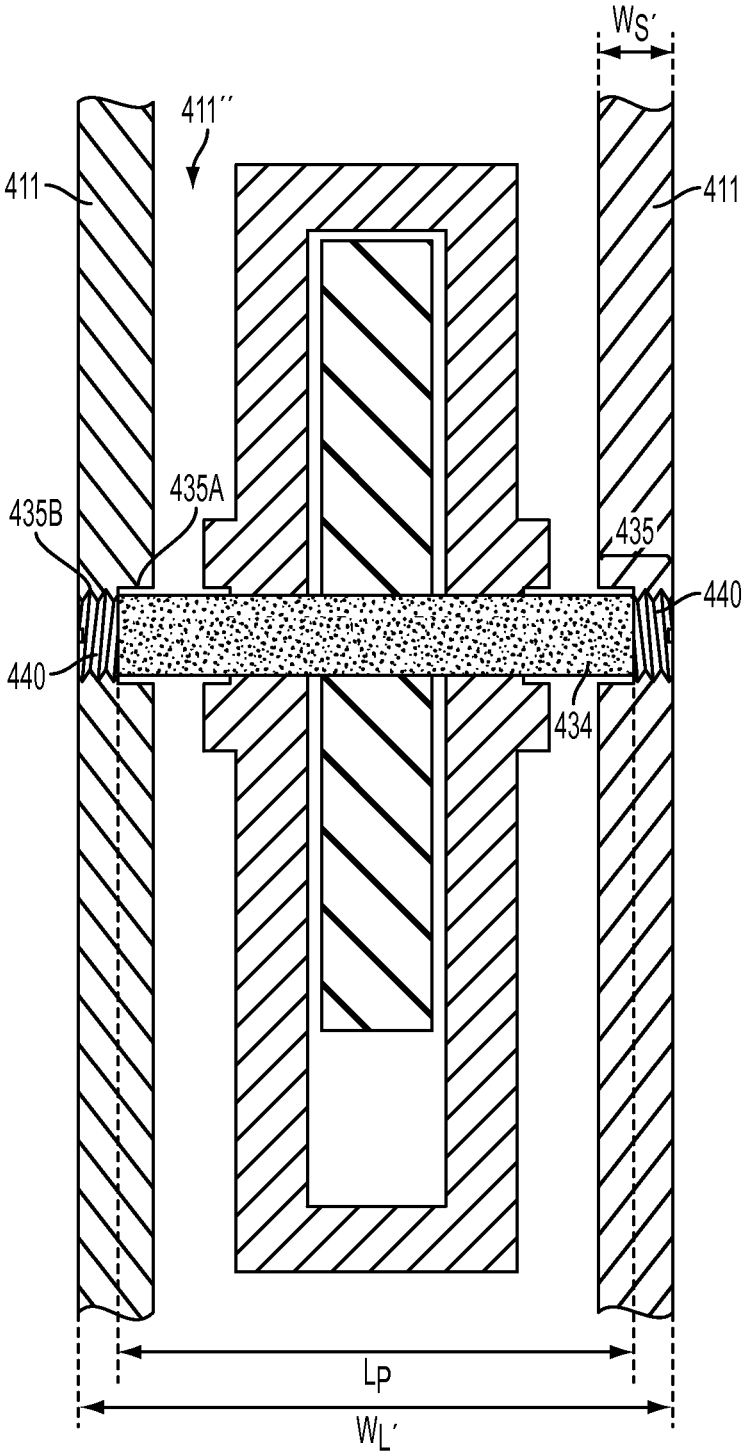
FIG. 8 is a top cross-sectional view of a fire control group and a third embodiment of an anti-walk pin assembly in accordance with the present invention.

A further embodiment of an anti-walk pin assembly in accordance with the present invention is shown in FIG. 8. Lower receiver sidewalls 411 have generally planar internal and external faces similar to sidewalls 111 discussed above. In the embodiment shown in FIG. 8, the lower receiver sidewalls do not include the provision of buttons on the external surface of the lower receiver. Rather, to prevent walking of the trigger pin, the FCG inserted within the FCG receptacle 411' includes a modified trigger pin 434. As discussed above with reference to FIG. 5, prior art FCGs employ a trigger pin having a length which is substantially the same as the width of the lower receiver. The embodiment of FIG. 8 substitutes trigger pin 434 which has a length, $L_P$, which is shorter than the width $W_{L'}$ of the lower receiver, but that is long enough such that the ends of the trigger pin 434 overlap at least some portion, but not all, of sidewall 411 when inserted into trigger pin receiving opening 435. Specifically, trigger pin 434 is sized to reside at an intermediate position within sidewall 411 without traversing the entire width $W_{S'}$ of the sidewall. Preferably, trigger pin receiving opening 435 formed within sidewall 411 is manufactured so that the internal portion of trigger pin receiving opening 435 (that portion closest to FCG receptacle 411') is a smooth bore 435A, while the remainder of the bore is threaded 435B. Ideally, the smooth bore portion 435A coincides with the overlap distance of trigger pin 434 within the trigger pin receiving opening 435 to support the trigger pin when assembled. A threaded fastener, such as set screw 440, is threaded within each threaded bore 435B to prevent lateral walking of the trigger pin. Preferably, set screw 440 is threaded within the bore such that the entirety of the screw is within the bore and no portion of the screw rests above the external surface of the sidewall.

While it is preferred that lower receiver sidewalls 411 are proportioned substantially similar to the lower receiver sidewalls of the prior art (e.g. as those shown and described above with reference to FIGS. 1-4 and reference numeral 111), it is envisioned that sidewalls 411 may be fabricated to have a greater thickness ($W_{S'}>W_S$) so as to increase the length of threaded bore portion 435B, and thus the usable length of fastener 440 threaded into the bore. However, increasing sidewall thickness increases the amount and weight of the materials used; but more detrimentally it increases the overall width ($W_{L'}$) of the lower receiver such that a lip or ledge is formed when pairing the upper and lower receivers to assemble a rifle.

It should be noted that, while each of the above embodiments was directed to a trigger pin, it will be appreciated by those skilled in the art that such embodiments are not specifically limited thereto, but such embodiments may further be employed in constructing an anti-walk pin assembly for the hammer/hammer pin.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. An anti-walk pin assembly for securing a fire control group having a trigger, disconnector and hammer within a firearm, the anti-walk pin assembly comprising:

a) a lower receiver defining a fire control group receptacle for housing at least one or more fire control group components, the lower receiver having trigger pin receiving openings each defining a trigger pin support surface, the lower receiver further including an opposing pair of buttons integrally formed thereon, each button extending outwardly from a generally planar surface of the lower receiver wherein each button further defines a respective trigger pin receiving opening;

b) a trigger pin at least partially received in the trigger pin receiving openings wherein the trigger and disconnector are pivotally mounted on the trigger pin; and c) a threaded fastener adapted to engage with a threaded portion of a respective trigger pin support surface to restrict lateral movement of the trigger pin within the trigger pin receiving openings.

2. The anti-walk pin assembly of claim 1 wherein the threaded portion of the trigger pin support surface is limited to a portion of the trigger pin receiving opening in the button and wherein the remainder of the trigger pin support surface is non-threaded.

3. The anti-walk pin assembly of claim 2 wherein the trigger pin is supported by the non-threaded portion of the trigger pin support surface.

4. The anti-walk pin assembly of claim 1 wherein the threaded fastener is a set screw.

5. The anti-walk pin assembly of claim 1 wherein the threaded fastener is a fillister screw.

6. The anti-walk pin assembly of claim 1 wherein each button further includes a recess adapted to house a head of a screw wherein the screw head does not extend above an external surface of the button when the screw is engaged within the trigger pin receiving opening.

7. An anti-walk pin assembly for securing a fire control group having a trigger, disconnector and hammer within a firearm, the anti-walk pin assembly comprising:

a) a lower receiver defining a fire control group receptacle for housing at least one or more fire control group components, the lower receiver having trigger pin receiving openings each defining a trigger pin support surface and hammer pin receiving openings each defining a hammer pin support surface, the lower receiver further including an opposing pair of trigger opening buttons and an opposing pair of hammer opening buttons integrally formed thereon, each button extending outwardly from a generally planar surface of the lower receiver wherein respective buttons define a respective trigger pin receiving opening or hammer pin receiving opening;

b) a trigger pin at least partially received in the trigger pin receiving openings wherein the trigger and disconnector are pivotally mounted on the trigger pin;

c) a hammer pin at least partially received in the hammer pin receiving openings wherein the hammer is pivotally mounted on the hammer pin and wherein the hammer is operably engaged with the trigger and disconnector;

d) a threaded trigger fastener adapted to engage with a threaded portion of a respective trigger pin support surface to restrict lateral movement of the trigger pin within the trigger pin receiving openings; and e) a threaded hammer fastener adapted to engage with a threaded portion of a respective hammer pin support surface to restrict lateral movement of the hammer pin within the hammer pin receiving openings.

* * * * *